US005915315A

United States Patent [19]

Bentz

[11] Patent Number: 5,915,315

[45] Date of Patent: Jun. 29, 1999

[54] EMBROIDERY HOOP WITH OVERLAPPING SEWING FIELDS AND METHOD

[76] Inventor: Joseph W. Bentz, 6 Meadowood La., Old Saybrook, Conn. 06475

[21] Appl. No.: 08/867,217

[22] Filed: Jun. 2, 1997

[51] Int. Cl.[6] ..... D05B 39/00

[52] U.S. Cl. ..... 112/103

[58] Field of Search ..... 112/103; 8/102, 8/102.2, 102.91

[56] References Cited

U.S. PATENT DOCUMENTS

| | | | |
|---|---|---|---|
| 4,357,885 | 11/1982 | Stockton | 112/103 |
| 5,138,960 | 8/1992 | Inteso | 112/103 |
| 5,546,877 | 8/1996 | Moore | 112/103 |

FOREIGN PATENT DOCUMENTS

| | | | |
|---|---|---|---|
| 3210296 | 9/1991 | Japan | 112/103 |
| 4108159 | 1/1992 | Japan | 112/103 |
| 4030891 | 2/1992 | Japan | 112/103 |

*Primary Examiner*—Ismael Izaguirre

*Attorney, Agent, or Firm*—Robert H. Montgomery

[57] ABSTRACT

An embroidery frame is provided for use with an embroidery machine of the type which includes a stitching head with a reciprocal needle and which includes drives for moving an embroidery frame in coordinate directions below the needle where one of the drives includes a first positioning and holding device for receiving and holding a complementary positioning device on an embroidery frame and where the extent of movement of the drives defines a field of stitch below the needle. The frame is a generally rectangular flat, one piece member defining a generally rectangular opening. A plurality of complementary positioning devices are mounted on at least one long side of the frame for positioning the frame with respect to the first positioning and holding device. The complementary positioning devices are linearly spaced along the at least one long side so that the fields of stitch of the machine overlap at adjacent edges when the frame is moved to successively position the complementary positioning devices into engagement with the first positioning and holding device. The opening in the frame is of a size corresponding to a plurality of fields of stitch which successively overlap.

13 Claims, 4 Drawing Sheets

EMBROIDERY HOOP WITH OVERLAPPING SEWING FIELDS AND METHOD

FIELD OF THE INVENTION

This invention relates to embrodery machines of the personal type, and more particularly relates to embroidary material frames and a method of using same on such machines.

BACKGROUND OF THE INVENTION

Embroidery machines of the personal type which move a hoop carrying embroidary material in X-Y coordinates beneath a stitching head have gained popularity for embroidaring small designs on various types of apparel and accessories such as shirts, jackets, caps, scarves etc.

These machines utilize a two part hoop to clamp a piece of material or portion of a piece of apparel. The hoop is attached to a movable carrier on the machine and moved in coordinate directions beneath the stitching head which includes a needle reciprocating in the Z direction. A typical machine of this type is shown in FIGS. 1 and 2 and a conventional hoop used therewith is shown in FIG. 3. Such machines are availabe from Singer Sewing Machine Company under the name embroidary Unlimited and from Aisin World Corporation Of America under the name P.O.E.M. Also embroidery accessory attachments are availabe for sewing machines made by Viking Husgvarna under the name Huskygram and from Pfaff.

All of these machines and accessory attachments utilize a hoop as shown in FIG. 3 to hold the material to be embroidered.

These hoops are dimensioned slightly larger than the field of stitch of the machine. The field of stich is the dimension of movement of the carriage in the X-Y cordinate diections which is typically 96mm by 96mm.

The machines and accessory attachments are usually driven in the X-Y directions by input from digital positional data commands from a personal computer. However the input may be from other programmed sources such as punch encoded tape read by a tape reader. Various designs such as initials, names, or any text in various font may be programmed on a tape or disc and selected by an operator for embroidery. Similarly, various graphic designs may be programmed in stitching patterns for read out by a personal computer or other device which outputs positional and stitch commands to the machine or acessory attachment device.

The available machines and accessory attachments provide very pleasing personalized text and graphic designs of embroidary on a piece of material. The primary limitation on these devices is the field of stitch of the machine or accessory attachment which limits the size of the text or graphic design which can be embroidered. This in turn has determined the size of the hoop which is used. The hoop generally follows the design and construction of the long known and used hand embroidery hoop comprising two concentric rings which hold the portion of material to be embroidered in tension therebetween.

As shown in FIG. 3, the presently used hoop comprises a defined inner member of generally square configuration, but having radii corners, surrounded by a similarly configured outer clamping member of somewhat deformable material having a split with a screw tightener extending across the split. The hoop also has an intergral extension thereon carrying a magnitizable member which attaches to a complementary positioning and holding magnet on the carriage of the embroidary machine or accessory attachment.

Also shown in FIG. 3, in broken line, is the field of stitch of the machine when the hoop is operatively position on the machine.

It is essentially impossible to remove material from a hoop as shown in FIG. 3 and reposition the material so as align a portion of completed embroidery to continue the embroidery with additional positioning and stitching data.

An object of this invention is to provide a new and improved material holding frame for machines of the type described which permits plural fields of stich without removal of the frame from the embroidery device.

Another object of this invention is to provide such a material holding frame which permits and facilitates repositioning of material with completed embroidery thereon so as to properly align the completed embroidery in a new field of stitch and permit a continuation of an embroidery pattern.

Another object of this invention is to provide a new and improved embroidery material holding frame and method of using same which permits a section of material to be postioned on an embroidery machine of the type described for plural fields of stitch in both X and Y coordinate directions.

A further object of the invention is to provide a hoop of the type described together with a template insert and method of using same which facilitates alignment of partially embroidered material on a frame with a new field of stitch.

SUMMARY OF THE INVENTION

Briefly stated the invention provides, in one form thereof, a generally flat, one piece frame with a hollow interior substantially larger than the field of stitch of the machine and having a plurality of complementary positioning and holding means thereon arranged to be complementary to and cooperate with the usual hoop positioner and holder on the carriage of the machine. The frame positioning and holding means on the frame are separated by a distance which provides a partial overlap of fields of stitch of said machine when succesive complementary positioning and holding means are successively attached to the carriage positioner and holder.

This permits the material to be embroidered to remain in the holder while embroidery is accomplished in two adjacent but slightly overlapping fields of stitch on the material. The frame further includes indicia providing reference for accurate repositioning of the embroidery material upon removal from the frame after completing a primary field of stitch and replacement on the frame for an additional field of stitch aligned with with the previously completed field of stitch.

The features of the invention which are believed to be novel are particularly pointed out and distinctly claimed in the concluding portion of this specification. The invention, however, together with further objects and advantages thereof may best be appreciated by reference to the following description taken in conjunction with the drawings.

DETAILED DESCRIPTION OF THE DRAWINGS

DESCRIPTION OF PREFERRED EMBODIMENTS OF INVENTION

Figure 2:
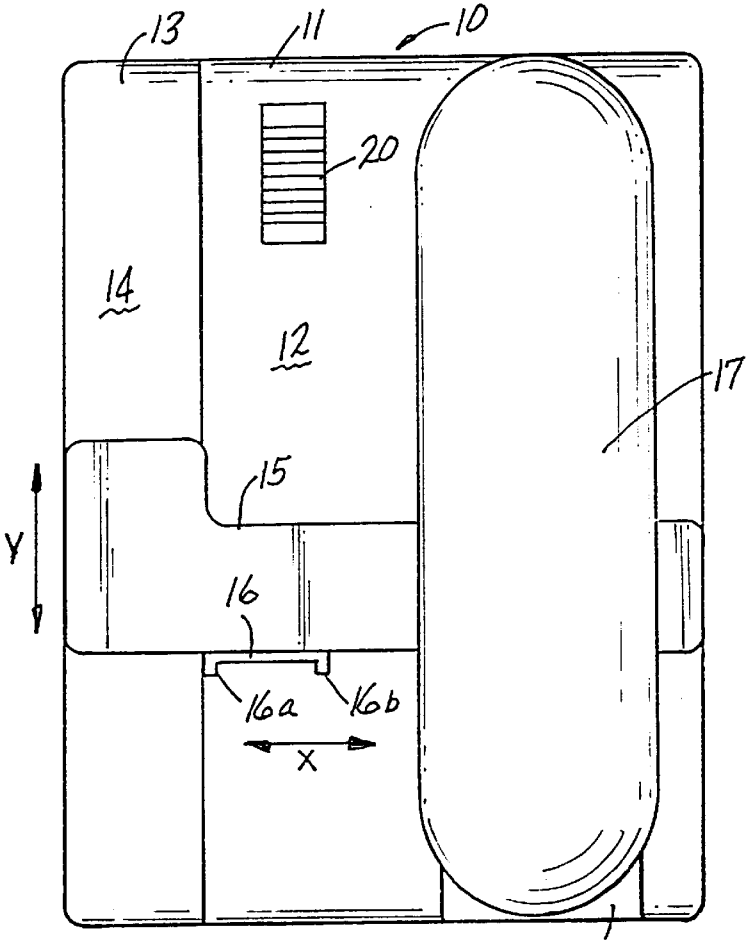
FIG-2 PRIOR ART
FIG. 2 is a plan view of the machine of FIG. 1.
Figure 1:
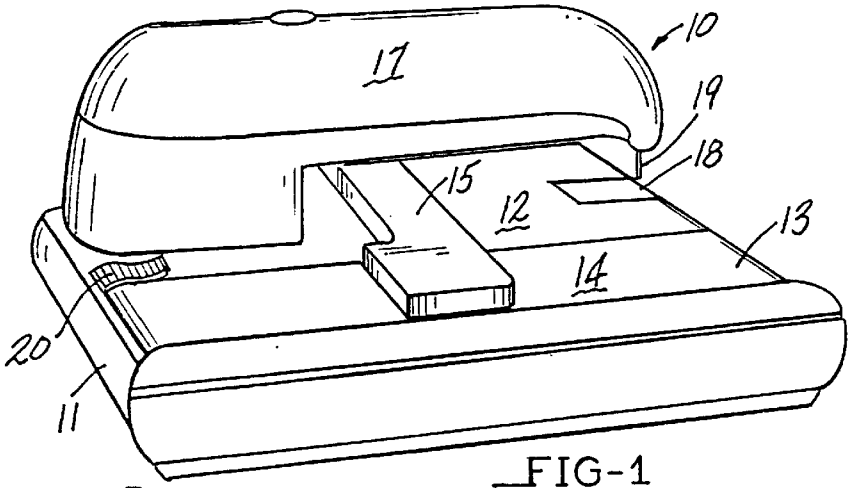
FIG-1 PRIOR ART
FIG. 1 is a perspective view of a typical personal embroidery machine.

FIG. 1 shows a perspective view of a typical personal embroidery machine and FIG. 2 shows an enlarged top plan view thereof. Machine 10 comprises a base 11 having an upper surface 12. A slide 13 is movable on base 11 by a positioning motor of a Y-axis drive (not shown in FIGS. 1 or 2, but indicated in FIG. 4). The Y- axis is indicated by the double ended arrow Y. The upper surface 14 of slide 13 is essentially coplanar with surface 12.

Slide 13 carries an arm 15 extending essentially perpendicular therefrom. Arm 15 carries a linearly movable hoop positioning and holding member 16 thereon. Member 16 is driven by a motor (not shown in FIGS. 1 or 2, but indicated in FIG. 4) in a coordinate X-axis as indicated by the double ended arrow X. Member 16 which is typically a magnet has two spaced apart ears 16*a* and 16*b* which position and hold a magnetizable complementary positioning and holding member on an embroidery hoop, as hereinafter described.

Machine 10 further comprises a head member 17 which overlies a platen 18 which is essentially coplanar with surface 12. Head 12 carries a motor and a needle reciprocating or drive mechanism (not shown in FIGS. 1 or 2, but indicated in FIG. 4). The needle which cooperates with a pressure foot plate is indicated at 19 in FIG. 1. Machine 10 also includes a switch 20 for adjustement of presser foot pressure.

A machine 10 as exemplified in FIG. 1 is representative of an Embroidery Unlimited (™) machine marketed by Singer Sewing Machine Company. Another similar machine is P.O.E.M (™) available from Aisin World Corporation of America.

Figure 3:
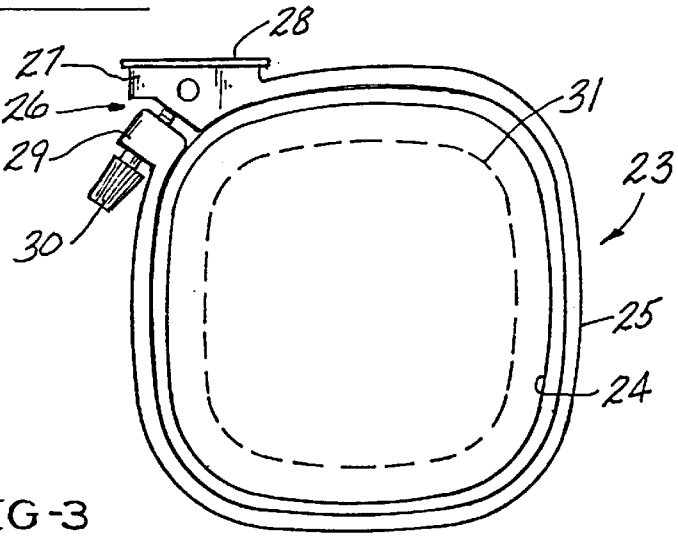
FIG-3 PRIOR ART
FIG. 3 is a plan view of a conventional embroidary hoop used in conjunction with the machine of FIGS. 1 and 2.

A typical embroidery hoop used with machine 10 is shown in FIG. 3. Hoop 23 comprises inner and outer rings 24 and 25, respectively. Inner ring 24 is continious and is arranged to be clamped within outer ring 25 to secure material to be embroidered therebetween. Outer ring 25 is split as indicated at 26. Outer ring 25 has a projection 27 formed thereon to which is secured a positioning and holding member 28 which is complimentery to member 16 on arm 15. Also formed on outer ring 25 is a tab 29 which receives a thumb screw 30 therethrough which is captured in projection 27. With this construction a section of material to be embroidered is releaseably captured between rings 24 and 25.

The hoop 23 with material to be embroidered is located with member 28 positioned between ears 16*a* and 16*b* of member 16. Member 28 is made of magnetic material and will be held by magnet member 16 between ears 16*a* and 16*b*. The embroidery material will be tensioned in the hoop by the machine operator, which tends to stretch the material.

In operation, the hoop 20 will be moved beneath the needle 19 and presser foot in the X and Y coordinate directions and a predetermined pattern will be stitched on the material in accordance with commmands supplied to the machine drives.

Figure 4:
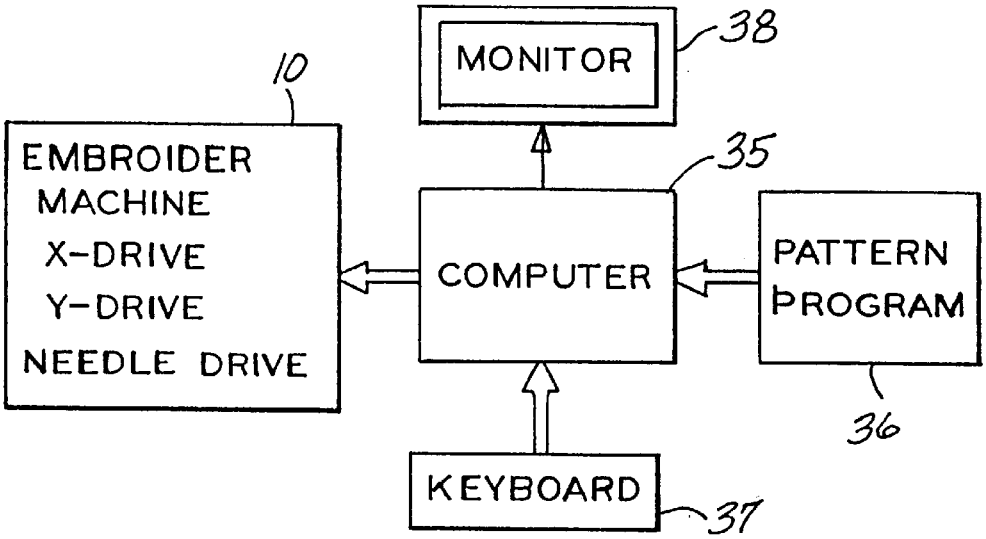
FIG. 4 is a block diagram of a system for operating the embroidary machine of FIGS. 1 and 2.

Machine 10 is operated under the control or direction of a personal computer 35, as shown in FIG. 4. Computer 35 accepts commands from a programmed disk or other memory device shown as pattern program 36 or from a conventional keyboard 37, or both. The usual monitor 38 is provided to display menus and other program information. The computer 35 will output positional information to machine 10, and more specifically to the X-axis drive, Y-axis drive and the needle drive as indicated in FIG. 4.

The identified personal embroidery machines have enjoyed much success and are sold with with almost identical software which is interchangeable in an associated personal computer which inputs to a machine 10. The software which is known as embroidery UNLIMITED for the Singer machine and CS-II (Compustitch) for the P.O.E.M. machine originate from Aisin World Corporation of America.

Personal embroidery machine operators are generally skilled in the operation and use of their machines. They may acquire created embroidery designs on floppy disks from several sources or digitize their own patterns using the identified software.

Yarns By The Shore of 6 Meadowood Lane, Old Saybrook, Connecticut, among others offers offers video cassettes of instructions for digitizing embroidary patterns. The same company, among others, offers floppy disks with selected programs of collections of embroidery patterns, as do the vendors mentioned above.

Accordingly, no discussion of the software used in the operation of personal embroidery machines is here required.

The machine 10 will have a "field of stitch" which is determined by the extent of movement of the X and Y drives to position hoop 22 beneath the needle. The field of stitch will be smaller than the field or area encompassed by inner hoop 23 due primarily to the presser foot and also by the pattern software. By movement of the hoop in X and Y coordinates beneath the needle 19 a programmed pattern may be attractively embroidered. The field of stitch of a machine 10 with a hoop 23 is represented in broken line 31 in FIG. 3.

A major limitation on machines of the type described with hoops of the type shown in FIG. 3 is the size of a pattern which may be embroidered. A conventional hoop of the type illustrated has interior dimensions of only about four and three-eights inches (4 ⅜") and five inches (5") corner-to-corner. It is virtually impossible to remove a section of material from a hoop 22 after accomplishing a first field of stitch and replace it in the hoop for a second field of stitch where the pattern of the second field is a continuation of or additive to the pattern of the first field.

The present invention provides a new and improved embroidery frame which greatly expands the capabilities of existing personal embroidery machines by providing the capability of greatly enlarged embroidery patterns.

Figure 5:
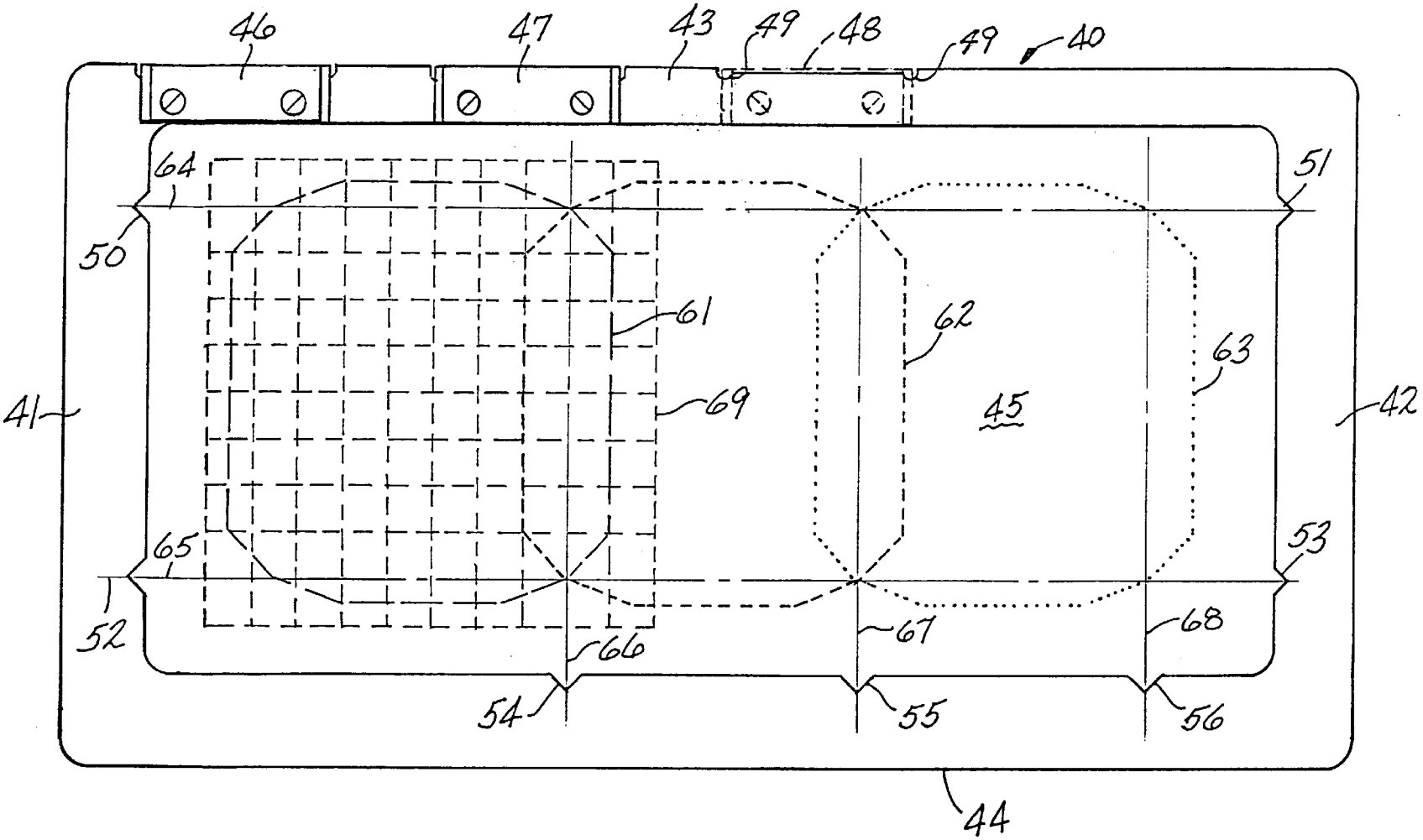
FIG. 5 is a plan view of an embroidery frame embodying the invention, and also showing fields of stitch of a typical embroidery machine within the borders thereof.

FIG. 5 is a plan view of a embroidery frame 40 embodying the invention. Frame 40 is of generally rectangular configuration having side rails 41 and 42, and top and bottom rails 43 and 44, respectively, defining a generally rectangular opening 45. Frame 40 is a flat stamped or molded piece. Top rail 43 receives three complementary positioning and holding members 46, 47 and 48. Member 48 is shown in broken line to exemplify how top rail is formed to receive members 46–48 and define recesses 49 to receive the positioning ears 16*a* and 16*b* of member 16. The members 46–48 are spaced apart by dimensions chosen to define three overlapping fields of stitch as hereinafter more fully described. Frame 40 further has defined therein reference indicia shown in the shape of V-shaped notches 50–56.

Figure 6:
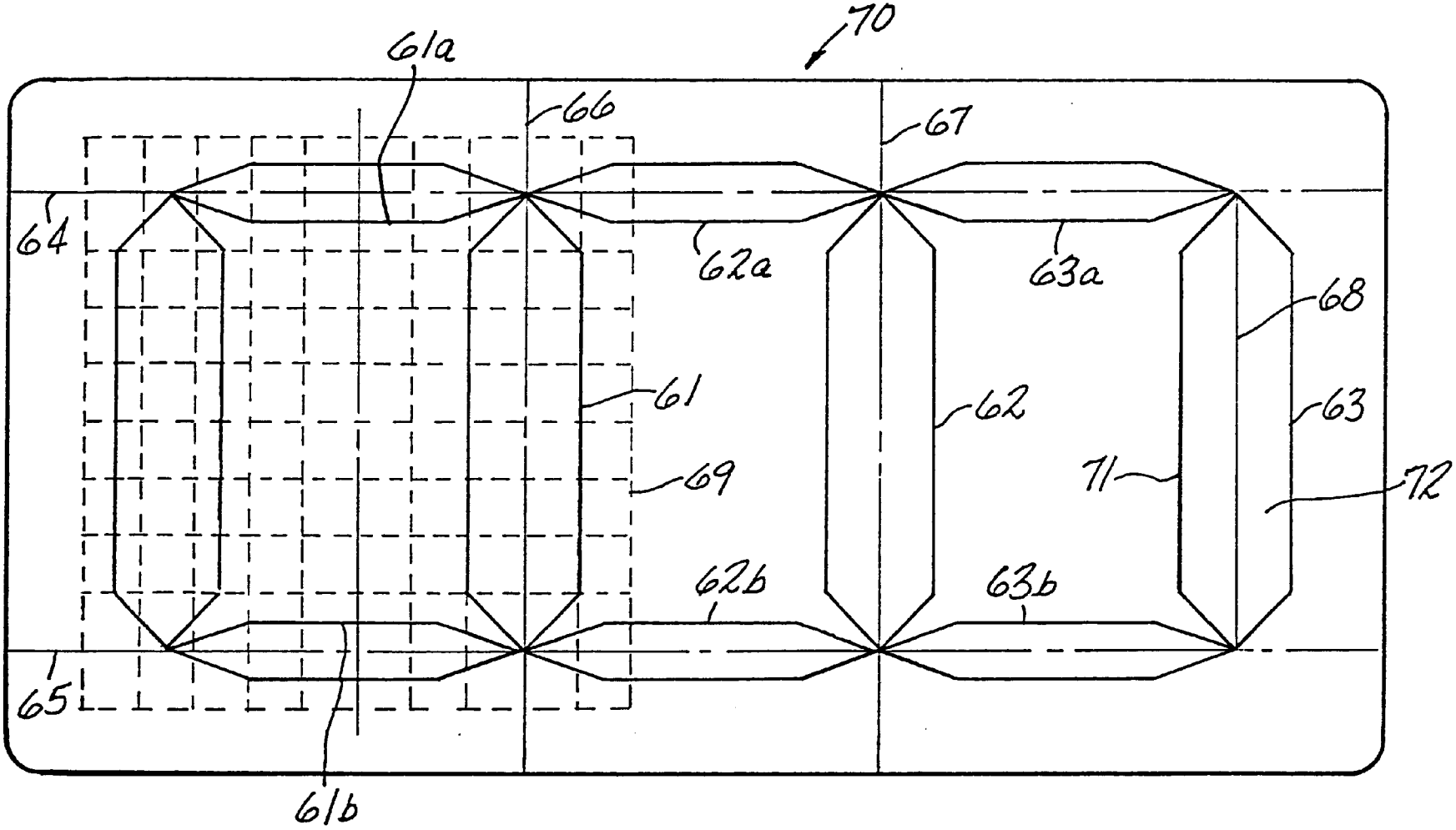
FIG. 6 is a plan view of a transparancy used with the frame of FIG. 5 which fits within the frame of FIG. 5.

These indicia and the spacing thereof are more fully explained in conjunction with FIG 6.

Frame 40 may be position on member 16 of machine 10 at any one of three positions by means of members 46, 47 and 48. At the position defined by member 46, a first field of stitch 61 (long dashed line) may be performed on material secured to frame 40 within opening 45. At the position defined by member 47, a second field of stitch 62 (short dashed line) which overlaps field 61 is performed on the material. This permits a pattern commenced in the first field of stitch 61 to be continued in the second field of stitch 62.

Likewise, at the position defined by member 48, a third field of stitch 63 (dotted line) which overlaps the second field of stitch 62. Thus a pattern may be continued horizontally through three fields of stitch without remmoval of material from frame 40. As hereinafter explained, the material may be removed from frame 40 and replaced thereon vertically for continuation of a pattern in the vertical direction.

In FIG. 5 center lines 64 and 65 are shown between indicia 50 and 51 and indicia 52 and 53, respectfully. Indicia 54 denotes the center of overlap 66 between fields of stitch 61 and 62. Indicia 55 denotes the center of overlap 67 between fields of stitch 62 and 63. Indicia 56 denotes the center of overlap 68 of field of stitch 63 and an additional field of stitch should the material be repositioned horizontally. An imaginery grid 69, hereinafter explained, is shown in FIG. 5, but forms no part of frame 40.

Material is affixed to frame 40 by adhering a piece of paper with an adhesive surface to the underside of frame 40 with the adhesive exposed in opening 45. An area of the material to be embroidered is then adhered to the exposed adhesive surface and may also be pinned to the paper at the rails of frame 40, if desired. A suitable paper is one known by the trademark Polyfilm which is available from E-Z Hoop Products Company of Warren, Ohio. This is a non-woven fibre with a water soluble temporary adhesive which may be stripped from the finished product, or the material bearing the product as then far completed stripped from the paper.

Frame 40 has essentially the same dimension between upper and lower rails 41 and 42 as the dimension across hoop 23, but in any event is chosen to have a vertical dimension slightly larger than the field of stitch of the embroidery machine with which it is to be used. The horizontal dimension across opening 45 will accomodate three fields of stitch of the embroidery machine with which it is used with overlap therebetween as illustrated.

FIG. 6 shows a transparency 70 used in conjunction with the frame of FIG. 5. Transparency 70 is an overlay for material affixed to frame 40 and is dimensioned to fit within opening 45 in frame 40. Transparency has depicted thereon the three fields of stitch 61, 62 and 63 dipicted in FIG. 5, but in full line, and center lines 64–67 in full line as appears on an actual transparency.

Transparency 70 also includes the grid 69 exemplified in FIG. 5. Transparency 70 also includes lines 61*a*, 62*a* and 63*a* at the upper portions of field of stitch 61, 62 and 63, respectively, and lines 61*b*, 62*b* and 63*b* at the lower portions of fields of stitch 61, 62 and 63, respectively. These lines are the mirror images of lines defining the fields of stitch above line 64 and below line 65, and partially define additional fields of stitch.

Embroidery of a pattern which contains no more than three fields of stitch will first be considered. Transparency 70 is imported in the software for a machine 10 and may be displayed on monitor 38 by itself or with a pattern or a portion(s) of a pattern to be stitched superimposed thereon. Several features are inherent in the software for a machine 10. Stitching may not be commenced unless the pattern is displayed on monitor 38. Initially the machine 10 will center a field of stitch beneath needle 19. Machine 10 will halt stitching after completing a pattern or a portion of a pattern programmed for a field of stitch.

To embroider a pattern which extends over three fields of stitch, the following steps are followed:

1. Transparency 70 is placed on the material to be embroidered aligned with the straight of grain. Grid 69 may be used for measurement and transparency 70 is used for locating purposes.
2. The outline of transparency 70 or a sufficient portion thereof for alignment purposes is marked on the material with an erasable marking pencil. Indicia locations 50–53 as represented by the ends of lines 64 and 65 may also be marked on the material.
3. The material is placed on frame 40 and the marked outline of transparancy 70 is aligned with the inside edges of frame 40. At this time. This is done by both sight and feel. The markings of the of lines 64 and 65 are aligned with indicia notches 50–53 which are felt by the operator through the material. When the operator is satisfied with the placement of the material on frame 40, the material is pressed against the adhesive paper throughout area 25. At any time during positioning of the material on frame 40, the operator may strip the material from the paper and realign.
4. Place member 46 on member 16 on arm 15. The digitized pattern program has previously been loaded. The Operator may view the pattern superimposed on transparency 70 on monitor 38 and make any positional adjustment desired.
5. By keyboard command machine 10 is caused to stitch the the first portion of the design in the first field of stitch 61. When the portion of the pattern in this field of stitch is completed machine 10 will automatically stop stitching.
6. The thread is cut as necessary, and frame 40 is moved to position member 47 on member 16. A keyboard command is then entered to cause machine 10 to stitch the second portion of the pattern in field of stitch 62.
7. The thread is cut and frame 40 is moved to position member 48 on member 16.
8. A keyboard command is entered to cause machine 10 to stitch the third portion of the pattern in field of stitch 63.

If the embroidary pattern only resides in fields 61, 62, and 63, the embroidery operation is complete, frame 40 is removed from machine 10, the material is removed from frame 40 and any necessary trim work performed. The operation is then complete.

Assume that the pattern required four to six fields of stitch. In such case the end of the third portion of the pattern would extend into the area of overlap of the third and forth fields of stitch, which corresponds to area 72 shown in FIG. 6. In such situation the following additional steps are performed when frame 40 is removed from machine 10:

9. Overlay transparency 70 on the material on the frame with grid 69 overlaying field of stitch 63 on the material (transparency 70 is reversed) and mark on both sides of grid 69 on transparency 70 where the last stitch occurred. The last stitch would be in the area designated 72 in FIG.6, between the end of field of stitch 63 and line 71, but on the material.

10. Mark the material at the extremities of lines 64 and 65 if not previously done and the last stitch on the material.
11. Strip the material from frame 40 and replace the adhesive paper as necessary.
12. Place transparency 70 on the material with the top and bottom edges aligned to the right with the previous marking of the material as accomplished in Step 2 and mark the material with continuation of the lines of Step 2.
13. Register the marking of the last stich made in area 72 on grid 69 when transparency 70 was reversed (Step 10) with the actual last stitch as marked on the material (Step 9) and mark the left end of transparency 70 on the material.
14. Using the markings on the material of the top and bottom of transparency 70, the left end of transparency 70, the markings of the extremities of lines 64 and 65 and the indicia notches 50–53 fit the material back onto frame 40 essentially as stated in Step 3. The indicia notches may be felt through the material and aligned with the markings on the material.
15. Repeat Steps 5–8 as necessary to accomplish stitching the pattern in up to three additional fields of stitch.

As one becomes experienced with use of frame 40 and transparency 70, shortcuts in the above enumerated steps may be taken such as marking only one end of the lines 64 and 65 for registry with the indicia notches at frame 40. With continued experience a person may modify or combine the steps enumerated above to their personal preference.

Embroidery of a pattern or design is usually performed left to right on a machine 10, and from top to bottom if necessary. Assume a pattern to be embroidered requires overlapping vertical fields of stitch instead of or in addition to the continued overlapping horizontal fields of stitch as thus far described. The necessary repositioning of material on frame 40 may be accomplished as described above with the following changes:

The sides of transparency 70 are primarily used for alignment in repositioning as are the indicia notches 54-56 and the extremities of lines 66 and 67. Assuming a pattern which required a three by two array of six fields of stich, transparency grid 69 is used to mark and record the location of the bottom most stitch in the overlap area at the bottom of each field of stitch 61 and 63 (field of Stitch 62 also if deemed necessary).The material is also marked at the bottom of lines 66 and 67 and/or at indicia notches 54, 55 and 56. The bottom pattern stitch marks on transparency 70 are placed in registery with the bottom stitches on the material in fields of stitch 61 and 63. The top of the transparency is then marked on the material. The material is then repositioned and aligned on frame 40 using the extended transparency outline markings and indicia 54–56 in the same manner as previously described. It will be understood for the machine 10 to accomplish a six field of stitch continious pattern, at least one of the pattern segments in the first three fields of stitch 61, 62 and 63 will extend into an overlap area which is partially defined by lines 61*b*, 62*b* or 63*b*.

While vertical embroidery is usually done from top to bottom, the lines 61*a*, 62*a*, and 63*a* on transparency 70 which partially define upper overlap areas permit transparency 70 to be used in an downward repositioning of material on frame 70.

Frame 40 maybe repositioned more than once on the material being embroidered to permit alignment of many overlapping fields of stitch.

Figure 7:
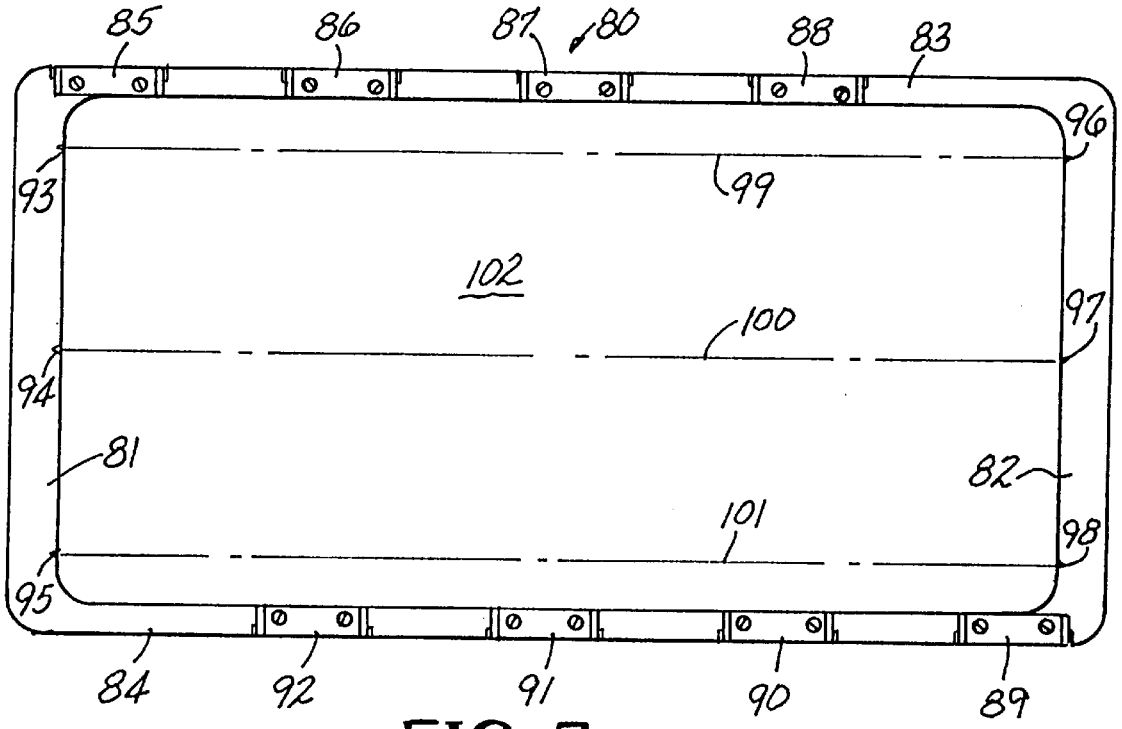
FIG. 7 is a plan view of another embroidery frame embodying the invention.

Another frame 80 embodying the invention is shown in Figure 7. Frame 80 is dimensioned to accomodate eight overlapping fields of stitch, and comprises side rails 81 and 82, and top and bottom rails 83 and 84, respectively. Top rail 83 has selectively positioned thereon complementary positioning and holding members 85–88 arranged to be engaged and held by member 16 on machine 10.

These positions will define four fields of stitch overlapping as fields of stitch 61, 62 and 63 in FIG. 5. Bottom rail has selectively positioned thereon four complementary positioning and holding members 89–92 arranged to engage member 16 on machine 10 for the same purpose as members 85–88. Frame 80 has recesses defined thereon on either side of members 85–88 and 89–92 to receive the ears 16*a* and 16*b* of member 16.

Side rail 81 has indicia in the form of V-shaped notches 93, 94 and 95 defined therein and side rail 82 has V-shaped notches 96, 97 and 98 defined therein. Indicia 93 and 96 define the extremities of a line 99, indicia 94 and 97 define the extremities of a line 100 and indicia 96 and 98 define the extrimities of a line 101, all between side rails 81 and 82. The lines 99–101 all define the center of overlap of fields of stitch.

Frame 80 defines an inside area 102 sufficient for eight fields of stitch. It is utilized in the same manner as frame 40 of FIG. 5, but in more cases will not have to repositioned to accomodate additional fields of stitch for a larger pattern size.

When frame 80 is used an additional support device (not shown) having an upper support surface essentially coplanar with machine surfaces 12 and 14 is provided for support since member 16 may not have sufficient holding power for frame 80 when slide 13 reaches a given forward position. Such support device would have an upper area sufficient to receive rails 81, 82 and/or 83 and provide support for the entire portion of frame 80 which may extend beyond surfaces 11 and 14 during stitching.

Frame 80 provides for the stitching of a pattern occuring in eight fields of stitch by successively positioning the members 85–88 on member 16, then repositioning frame 80 to successively position members 89–92 on member 16 without having to reposition the material on the frame. The indicia 93–98 provide definition of the three lines 99, 100 and 101 for purposes of alignment if it should be necessary to reposition material on the frame for a pattern which extended horizontally beyond four fields of stitch.

A frame 80 designed for the types of machine described has interior dimensions of approximately twelve and one quarter inches (12.25") between rails 81 and 82 and approximately seven and seven tenths inches (7.7") between rails 83 and 84. This accommodates two rows of four overlapping fields of stitch across with the second row overlapping corresponding fields of the first row.

A frame 40 as shown in FIG. 5 has a vertical inside dimension between rails 43 and 44 essentially same as the dimension across hoop 22 of FIG. 3.

It will be apparent that the size of a frame will depend on the dimensions of the field of stitch of the embroidery machine.

The extent of overlap of adjacent fields need only be sufficient to permit a section of a pattern which ends in one field of stitch to also reside in the adjacent field of stitch so the embroidered stitching ending in the first field of stitch may be continued in the next adjacent field of stitch.

By way of example only, the defined fields of stitch 61, 62 and 63 on transparency 70 have a horizontal dimension of substantially three and one quarter inches (3 ¼") and the dimension of overlap horizontally is three-quarter inch (¾"). The vertical dimension of the fields of stitch 61, 62 and 63 is substantially three and one-half inches (3 ½") and the dimension of overlap in the vertical direction is substantially three-eights inch (⅜").

It may thus be seen that the objects of the invention set forth above as well as those made apparent have been efficiently attained. While preferred embodiments of the invention have been set forth for purpose of disclosure, modifications to the disclosed embodiments as well as other embodiments may occur to those skilled in the art. Accordingly, the appended claims are intended to cover all embodiments and modifications to the disclosed embodiments which do not depart from the spirit and scope of the invention.

What is claimed is:

1. An embroidery frame for use with an embroidery machine of the type which includes a stationary stitching head with a reciprocatable needle and which includes drives for moving an embroidery frame in coordinate directions below the needle where one of the drives includes a first positioning and holding device for receiving and holding a complementary positioning device on said embroidery frame and where the extent of movement of said drives defines a field of stitch below said needle, said frame comprising; a generally rectangular flat, one piece member having a generally rectangular central opening defined by opposed top and bottom rails and opposed siderails, said central opening being sized in accordance with a predetermined number of overlapping fields of stitch, a plurality of complementary positioning devices on at least one of said upper and lower rails for positioning said member with respect to said first positioning and holding device, said complementary positioning devices being linearly spaced along said at least one of said top and bottom rails so that fields of stitch of said machine overlap at adjacent edges thereof when said member is moved to successively position said complementary positioning devices into engagement with said first positioning and holding device.

2. The embroidery frame of claim 1 where each of said complementary positioning devices is located on said at least one side.

3. The frame of claim 1 wherein indicia notches indicative of the centers of overlap of said fields of stitch are defined in said bottom rail and said side rails.

4. The frame of claim 3 further including a transparency dimensioned to snugly fit within said opening in said frame, said transparency having defined thereon a plurality of overlapping fields of stitch where the center of overlap of said defined fields of stitch are aligned with said indicia notches.

5. The frame and transparency of claim 4 wherein said transparency further includes a grid thereon overlying one of the defined fields of stitch and said transparency is reversible.

6. The frame of claim 3 wherein said indicia notches are defined on the inside of said rails.

7. The frame of claim 1 wherein said complementary positioning devices are located along said top and bottom rails for engagement with said positioning and holding device, said central opening defining an area which accepts two rows of fields of stitch.

8. The frame of claim 7 wherein indicia notches are indicative of the center of overlap of said two rows of fields of stitch are defined in said side rails.

9. The frame of claim 8 further including a transparency dimensioned to snugly fit within said opening in said frame, said transparency having defined thereon a plurality of overlapping fields of stitch where the center of overlap of said defined fields of stitch are aligned with said indicia notches.

10. The frame of claim 7 wherein said first holding and positioning device is a magnet and said complementary positioning devices are of magnetizable material.

11. The frame of claim 7 wherein said indicia notches are defined on the inside of said rails.

12. The frame of claim 1 wherein said first holding and positioning device is a magnet and said complementary positioning devices are of magnetizable material.

13. A method of embroidery using a machine of the type which includes a stitching head with a reciprocatable needle and which includes drives for moving an embroidery frame in coordinate directions below the needle where one of the drives includes a first positioning and holding device for receiving and holding a complementary positioning device on an embroidery frame and where the extent of movement of said drives defines a field of stitch below said needle comprising the steps of: providing a flat frame having upper, lower and side rails defining a generally rectangular central opening, said central opening being sized in accordance with a predetermined number of overlapping fields of stitch and at least one rail having a plurality of complementary positioning devices thereon for attachment to said first positioning and holding device, adhering a piece of material to be embroidered to said frame, positioning said frame on said machine with one of said complementary positioning devices in contact with said first positioning and holding device, utilizing said machine to embroidery at least a portion of a pattern in a first field of stitch transferring said frame to a position where a second of said complementary positioning devices is in contact with said first positioning and holding device and utilizing said machine to embroidery a continuation of the pattern in a second field of stitch which overlaps said first field of stitch.

* * * * *

UNITED STATES PATENT AND TRADEMARK OFFICE

CERTIFICATE OF CORRECTION

PATENT NO. : 5,915,315
DATED : June 29, 1999
INVENTOR(S) : Joseph W. Bentz, and Laverne J. Horton It is certified that error appears in the above-identified patent and that said Letters Patent is hereby corrected as shown below:

Title page,
Item [75], Inventors: Joseph W. Bentz, 6 Meadowood Lane, Old Saybrook, CT 06475 and Laverne J. Horton, 3404 Catherine Street, Goldsboro, NC 27534

Signed and Sealed this

Fifth Day of March, 2002

*Attest:*

*Attesting Officer*

JAMES E. ROGAN
*Director of the United States Patent and Trademark Office*